US007681734B2

(12) United States Patent
Liao et al.

(10) Patent No.: US 7,681,734 B2
(45) Date of Patent: Mar. 23, 2010

(54) AIR EVACUATIVE BINDING TYPE AIR PACKING BAG AND PACKING METHOD USING THE SAME

(75) Inventors: Chieh Hua Liao, 4F., No. 7, Lane 130, Mincyuan Rd., Sindian City, Taipei County (TW); Yaw Shin Liao, Sindian (TW); Yao Chuan Liao, Sindian (TW)

(73) Assignee: Chieh Hua Liao, Sindian (TW)

( * ) Notice: Subject to any disclaimer, the term of this patent is extended or adjusted under 35 U.S.C. 154(b) by 0 days.

(21) Appl. No.: 11/964,280

(22) Filed: Dec. 26, 2007

(65) Prior Publication Data

US 2008/0313996 A1 Dec. 25, 2008

(30) Foreign Application Priority Data

Jun. 22, 2007 (TW) ..... 96122627 A

(51) Int. Cl.
*B65D 81/03* (2006.01)
*B65D 81/20* (2006.01)
*B65D 30/00* (2006.01)

(52) U.S. Cl. ..... 206/522; 206/524.8; 383/3

(58) Field of Classification Search ..... 206/522, 206/524.8; 383/3

See application file for complete search history.

(56) References Cited

U.S. PATENT DOCUMENTS

| | | | | |
|---|---|---|---|---|
| 5,875,897 | A * | 3/1999 | Duncan et al. | 206/714 |
| 7,128,211 | B2 * | 10/2006 | Nishi et al. | 206/522 |
| 2003/0108699 | A1 | 6/2003 | Tanaka | |
| 2004/0232031 | A1 * | 11/2004 | Nishi et al. | 206/521 |

FOREIGN PATENT DOCUMENTS

| | | | |
|---|---|---|---|
| CN | 1517277 | A1 | 8/2004 |
| JP | 2003-137352 | A1 | 5/2003 |
| TW | M297919 | Y | 9/2006 |

* cited by examiner

*Primary Examiner*—J. Gregory Pickett
(74) *Attorney, Agent, or Firm*—Apex Julis, PLLC; Tracy M Heims

(57) ABSTRACT

In an air evacuative binding type air packing bag and a packing method using the same, an air cylinder is bended to form a first cushioning wall and a second cushioning wall, two sides of the first cushioning wall and the second cushioning wall are adhered to each other to form an accepting space. Next, an article is placed in the accepting space, and air in the accepting space is then evacuated to allow the first cushioning wall and the second cushioning wall to bind the article up to retain the article in the accepting space and not to be shaken with the air packing bag.

6 Claims, 10 Drawing Sheets

AIR EVACUATIVE BINDING TYPE AIR PACKING BAG AND PACKING METHOD USING THE SAME

CROSS-REFERENCES TO RELATED APPLICATIONS

This non-provisional application claims priority under 35 U.S.C. §119(a) on Patent Application No(s). 096122627 filed in Taiwan, R.O.C. on Jun. 22, 2007, the entire contents of which are hereby incorporated by reference.

FIELD OF INVENTION

The present invention relates to an air packing bag and a packing method using the same, and more particularly to a vacuum binding type air packing bag and a packing method using the same.

BACKGROUND

Generally, an article is directly placed into a paper box while being packed. However, the paper box can only be used for packing the article and has no cushioning protection function to cause the article to be damaged easily owing to shake while being transported such that cushioning material is usually placed in the paper box during the packing to elevate the cushioning protection function of the paper box. A general used way is to fill foam between the article and the paper box thereby using the softness of the foam to provide the cushioning protection for the article. However, the price of foam is so high as to cause the packing cost to be increased and thus, it is of no economic interest. Besides, foam is not easy to be processed such that it is harmful to the environment protection. Moreover, although the foam can be tightly attached onto a surface of the article, the collision prevention effect is not good such that the article is still often subjected to collision to cause damage.

Another common cushioning material is Styrofoam. An article is first wrapped by means of Styrofoam, and then placed in a paper box so as to prevent the article from being collided during the transportation. Although Styrofoam can prevent the article from being damaged due to shake, the volume of Styrofoam fluffily occupies a great deal of space and not easy to be decomposed by microorganism as well as will release poison gas to endanger human bodies during an incineration process to cause a serious environmental pollution; Styrofoam is not an ideal cushioning material in nowadays of environmental consciousness upsurge. Moreover, Styrofoam with a fixed size cannot be used for packing all different dimensions and sizes of articles; a different dimension of Styrofoam must be only used for a specific article; this not only is resources wasting but also increases the article packing cost.

For solving the problems mentioned above, an air packing bag made by hot-sealing two sheets of thin plastic film is generated thereby providing a cushioning protection use to an article while being shaken. Although the air packing bag can provide a better cushioning protection, the article is easy to pierce the air packing bag through due to the shake in the air packing bag if the article is provided with sharp angles or hardware joint corners. If a small breach appears on the air packing bag, air in the air packing bag will then be leaked out to cause the air packing bag to loose the cushioning protection effect and further to increase the article packing cost. For solving this problem, the thin plastic film of the air packing bag may be thickened or strengthened so as to avoid being pierced through by the article as far as possible. But, it is impossible to strengthen or thicken only one single face of the air packing bag in a continuous mass production, all faces of the air packing bag must be strengthened or thickened; it leads to a high production cost to loose the market competitiveness.

SUMMARY

For improving the deficits mentioned above, the present invention proposed an air evacuative binding type air packing bag, comprising:

two outer films, stacked with each other vertically;

two inner films, positioned between the two outer films and a heat resisting material being spread between the two inner films;

at least one air cylinder, formed between the two outer films by adhering the two outer films to each other by means of hot sealing and used for storing air;

an air filling passageway, positioned at one side of the air cylinder;

at least one air inlet, formed by adhering the two inner films to each other by means of hot sealing and used for communicating the air cylinder with the air filling passageway;

a first cushioning wall, formed by bending one side of the air cylinder;

a second cushioning wall, formed by bending another side of the air cylinder; and an accepting space, positioned between the first cushioning wall and the second cushioning wall, used for accepting an article and allowing the first cushioning wall and the second cushioning wall to bind the article up by means of air evacuation.

The present invention also proposes a packing method using a vacuum binding type air packing bag, comprising the following steps:

providing two inner films;

stacking two outer films together to allow the two inner films to be positioned between the two outer films;

hot sealing the outer films and the inner films, forming at least one air cylinder between the two outer films, forming at least one air inlet by not adhering the inner film to other films even by hot sealing, in which each air inlet is corresponding to each air cylinder;

bending the cylinders to form a first cushioning wall and a second cushioning wall;

hot sealing two sides of the first cushioning wall and the second cushioning wall to form an accepting space;

placing an article into the accepting space; and evacuating air in the accepting space to cause the first cushioning wall and the second cushioning wall to bind the article up.

The article is accepted in the accepting space according to the present invention, when the air cylinders are filled with air and expanded, the first cushioning wall and the second cushioning wall can then bind the article up to enable the article to be retained in the accepting space and not to be shaken with the air packing bag; this not only strengthens the cushioning protection to the article, but also solve the problem that the air packing bag is pierced through easily by the article.

BRIEF DESCRIPTION OF THE DRAWINGS

The present invention can be more fully understood by reference to the following description and accompanying drawings, in which.

DETAILED DESCRIPTION

Figure 1:
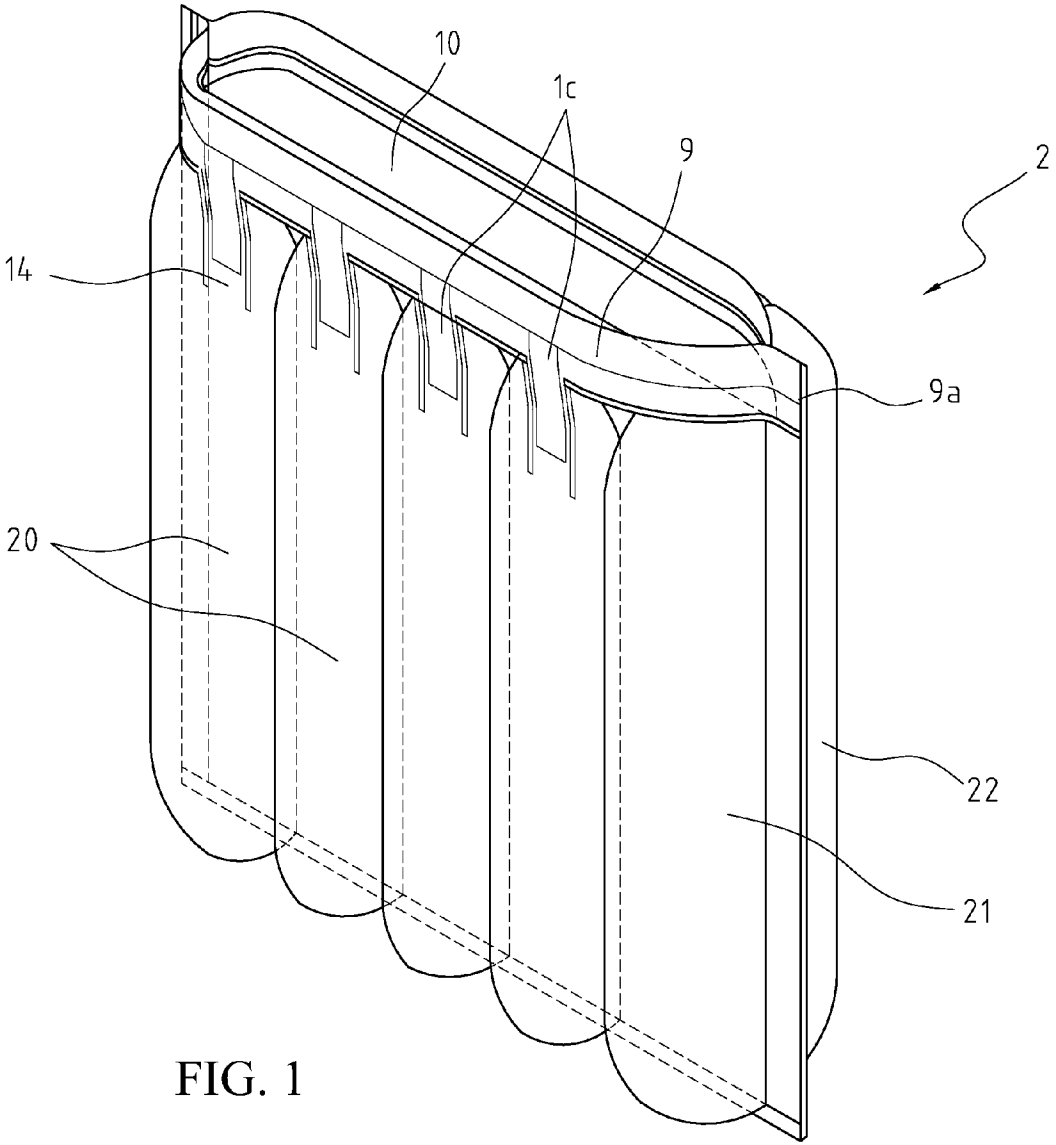
FIG. 1 is a perspective view, showing an air packing bag of a first preferred embodiment according to the present invention after air filling.
Figure 2:
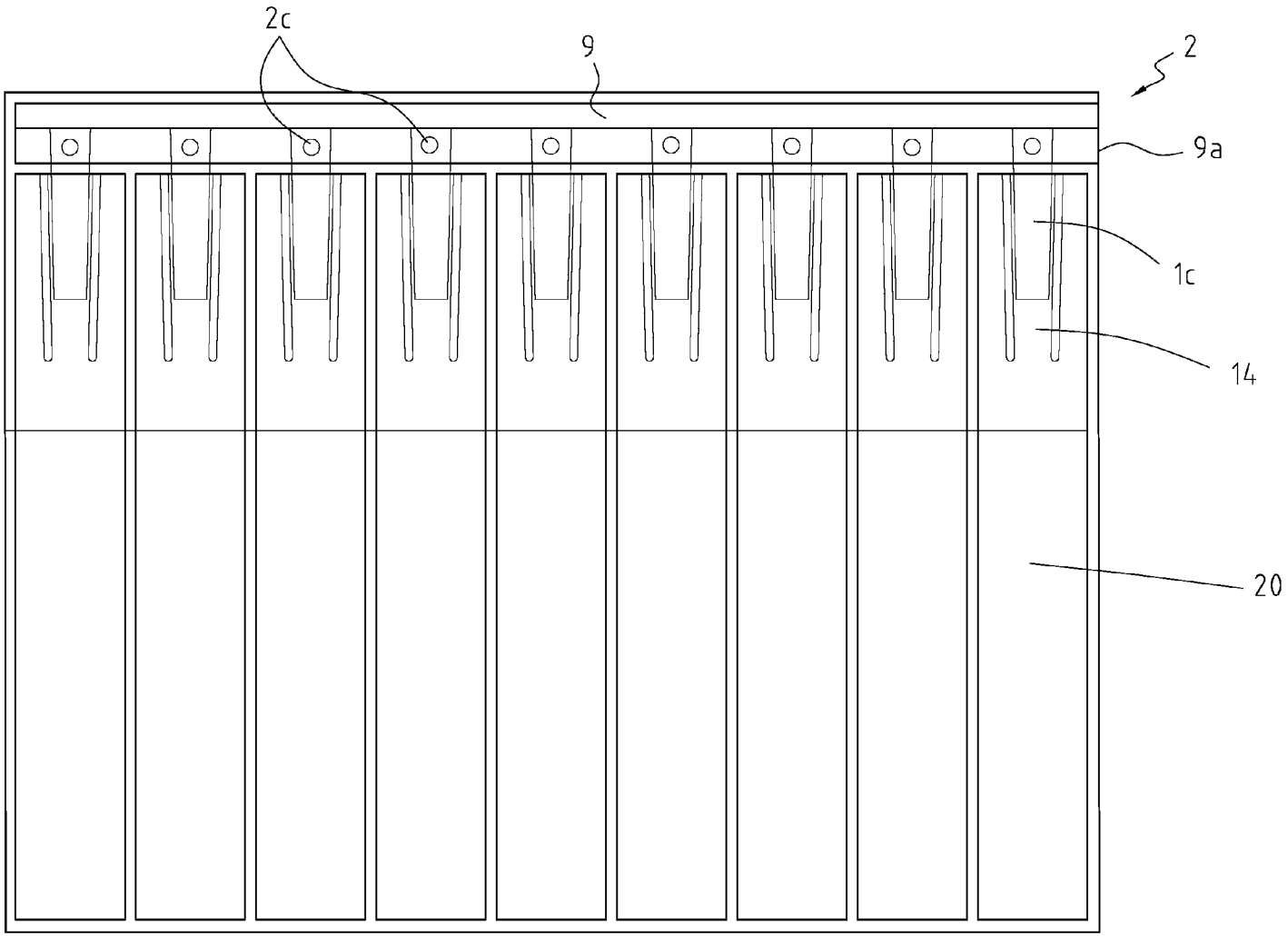
FIG. 2 is a plane view, showing the air packing bag of the first preferred embodiment according to the present invention before air filling.
Figure 3A:
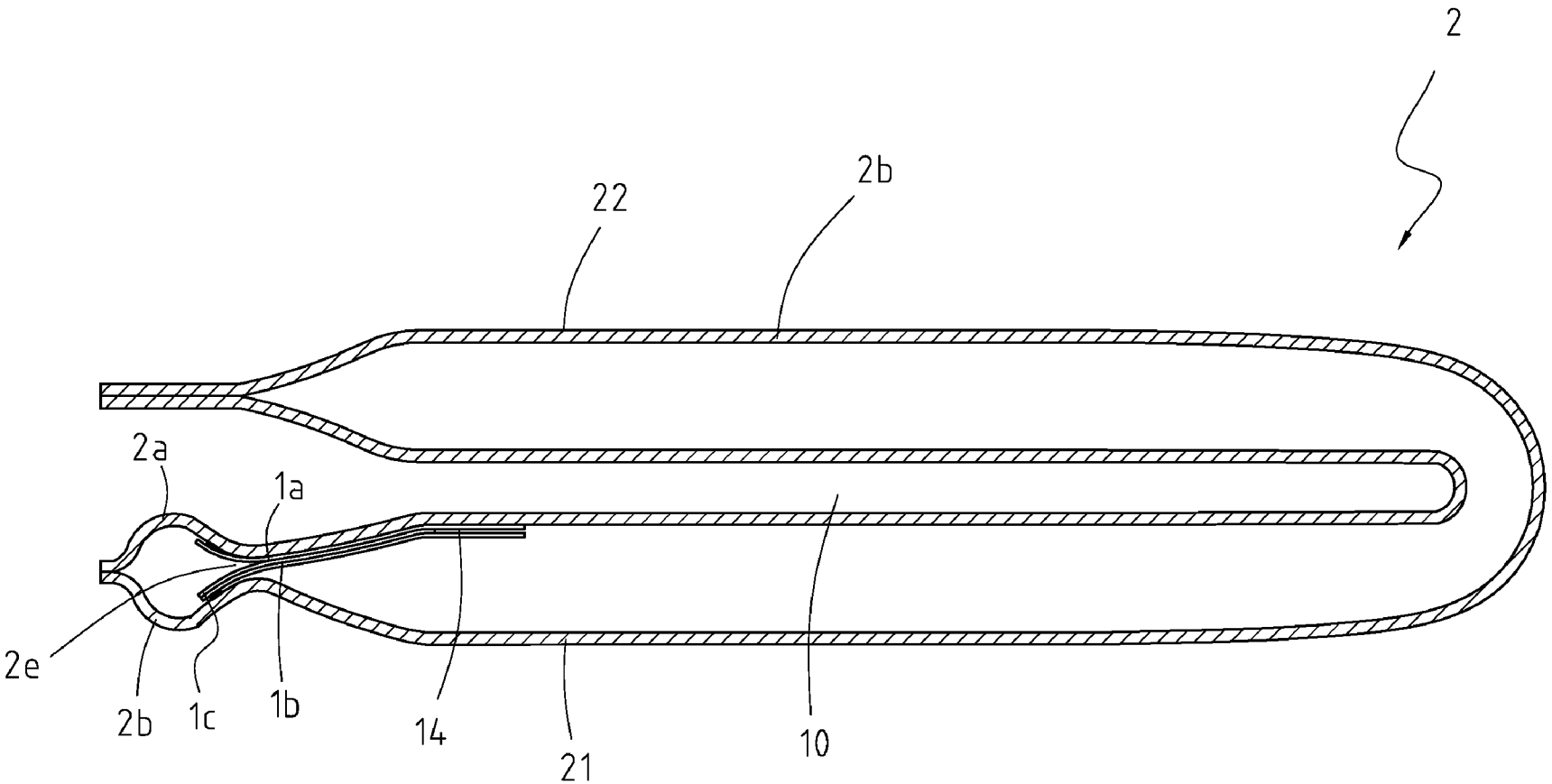
FIG. 3A is a cross sectional view, showing the air packing bag of the first preferred embodiment according to the present invention.
Figure 3B:
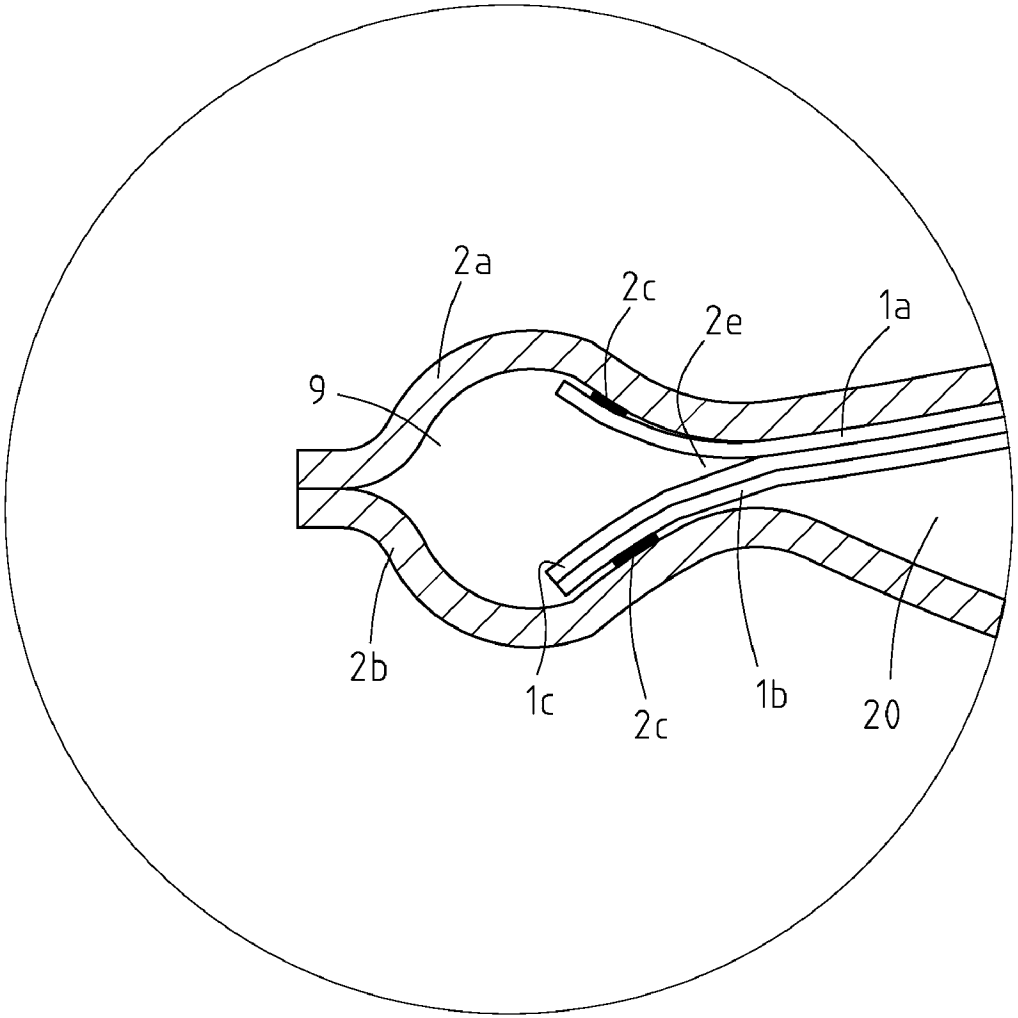
FIG. 3B is a partly enlarged view of the air packing bag shown in FIG. 3A.

Please refer to FIGS. 1, 2, 3A and 3B. FIG. 1 is a perspective view, showing an air packing bag of a first preferred embodiment according to the present invention after air filling. FIG. 2 is a plane view, showing the air packing bag of the first preferred embodiment according to the present invention before air filling. FIG. 3A is a cross sectional view, showing the air packing bag of the first preferred embodiment according to the present invention. FIG. 3B is a partly enlarged view of the air packing bag shown in FIG. 3A.

A vacuum binding type air packing bag comprises an air cylinder sheet 2 and an accepting space 10.

The air cylinder sheet 2 is constituted by at least one air cylinder 23 and formed to be a first cushioning wall 21 and a second cushioning wall 22 by means of bending. Besides, each air cylinder 20 comprises an air inlet 2*e* used for allowing air to enter the air cylinder 20 to cause it to be filled with air and expanded.

According to the air cylinder sheet 2 disclosed by the present invention, two sheets of inner film 1*a*, 1*b* are disposed between two sheets of outer film 2*a*, 2*b* after the two sheets of outer film 2*a*, 2*b* are stacked together vertically, hot sealing points 2*c* are generated by means of hot sealing so as to adhere the outer film 2*a* to the inner film 1*a* and the outer film 2*b* to the inner film 1*b*. Furthermore, the two sheets of outer film 2*a*, 2*b* are adhered to each other by hot sealing and in the meantime, the two sheets of inner film 1*a*, 1*b* are adhered to each other by hot sealing so as to form the air cylinders 20 between the two sheets of outer film 2*a*, 2*b*. Thereafter, the two sheets of inner film 1*a*, 1*b* are not adhered to each other to form at least one air inlet 2*e* between the two sheets of inner films 1*a*, 1*b* after a heat resistant material 1*c* is spread between the two sheets of inner film 1*a*, 1*b* to be used for communicating the air cylinder 20 with the outside. Besides, each air inlet 2*e* is connected with an air passageway 14, which is formed between the two sheets of inner film 1*a*, 1*b* by adhering the two inner films 1*a*, 1*b* to each other by means of hot sealing after a heat resistant material 1*a* is spread between the two sheets of inner film 1*a* and 1*b*.

The accepting space 10 is positioned between the first cushioning wall 21 and the second cushioning wall 22 and used for accepting an article 100. Air in the accepting space 10 is evacuated to enable the first cushioning wall 21 and the second cushioning wall 22 to bind the article 100 up. Here, a user may evacuate air in the accepting space 10 through an air evacuation component 5 to cause the accepting space 10 to be formed in an almost vacuum state or a vacuum state.

Besides, the air packing bag further comprises an air filling passageway 9 positioned at one side of the air cylinders 20 to allow the air cylinders 20 to be arranged side by side at one side of the air filling passageway 9, and the air inlet is used to communicate the air cylinder 20 with the air filling passageway 9, in which the air filling passageway 9 is an air passable space formed by adhering the two sheets of outer film 2*a* and 2*b* by hot sealing and an air filling entrance 9*a* is formed on one end of the air filling passageway 9. After air entering the air filling entrance 9*a* expands the air passageway 9, the two sheets of outer film 2*a* and 2*b* are pulled outward and in the meantime, the two sheets of inner film 1*a* and 1*b* are driven to extend outward through the hot sealing points 2*c* so as to open the air inlet 2*e* to allow the air to enter the air cylinder 20 via the air passageway 14. After the air cylinder 20 is filled with air and expanded, the internal air pressure of the air cylinder 20 compresses the two sheets of inner film 1*a* and 1*b* to attach tightly onto the outer film 2*a* or 2*b* (according to a structure difference, the two sheets of inner film 1*a* and 1*b* may also not be side-attached on the outer film 2*a* or 2*b* but hung in the air in the air cylinder) to cover the air passageway 14 to shield the air cylinder 20 to allow the air in the air cylinder 20 not to be leaked out to attain to the air locking effect.

Figure 4:
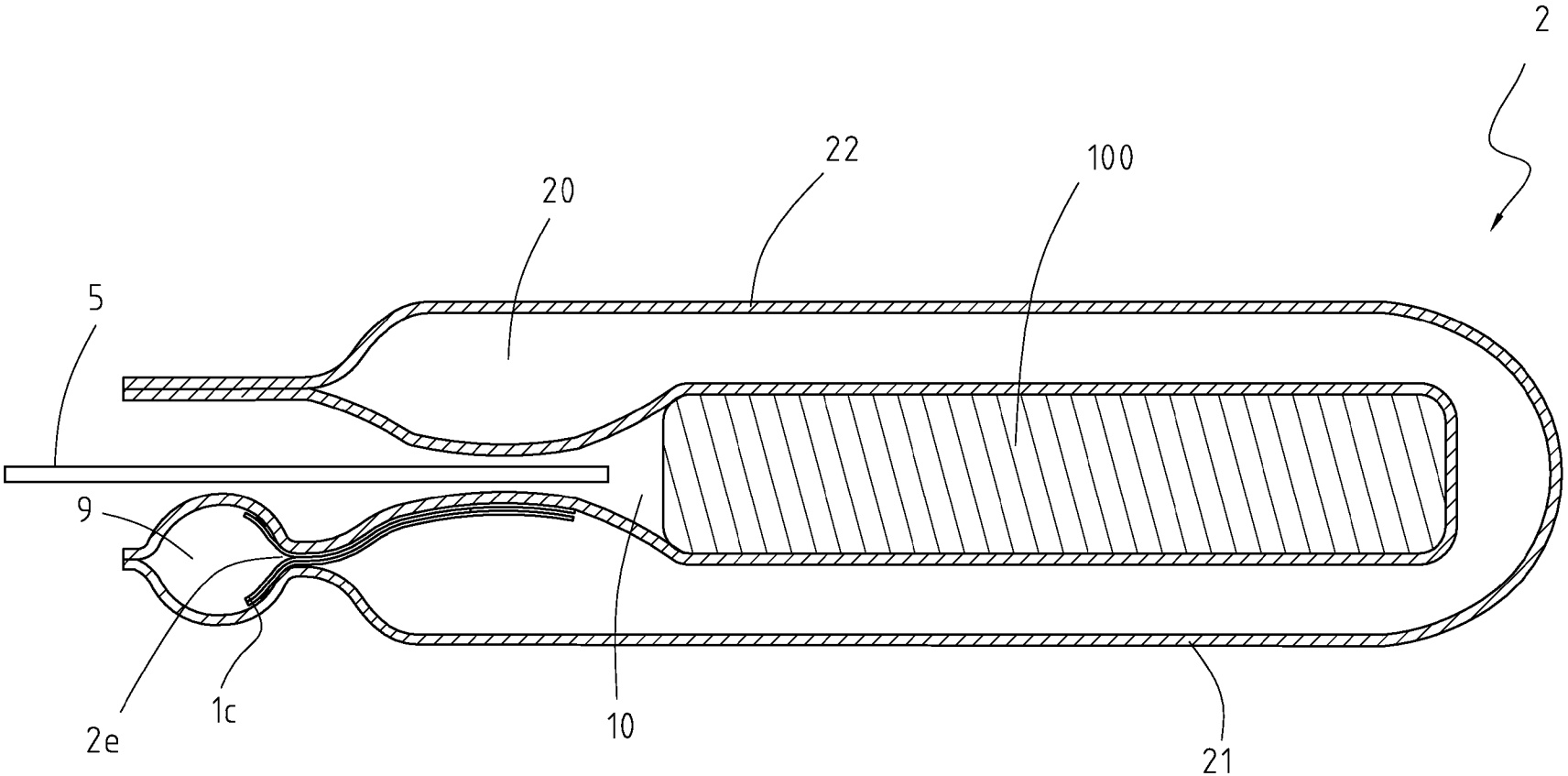
FIG. 4 is a cross sectional view, showing the air packing bag of the first preferred embodiment according to the present invention when air is evacuated.
Figure 5:
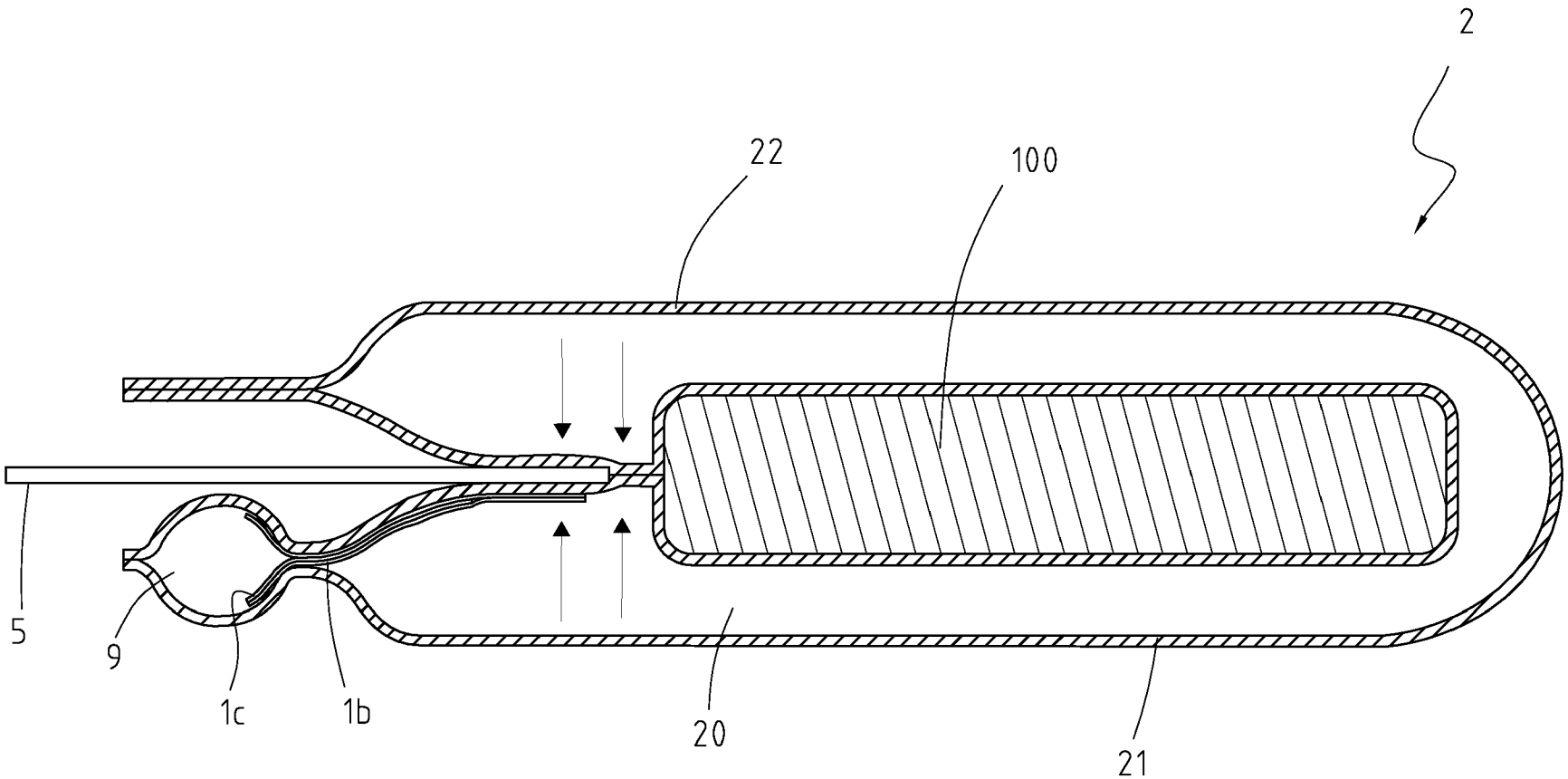
FIG. 5 is a cross sectional view, showing the air packing bag of the first preferred embodiment according to the present invention after air is evacuated.

Please refer to FIGS. 4 and 5. FIG. 4 is a cross sectional view, showing the air packing bag of the first preferred embodiment according to the present invention when air is evacuated. FIG. 5 is a cross sectional view, showing the air packing bag of the first preferred embodiment according to the present invention after air is evacuated.

When a user places the article 100 in the accepting space 10, the first cushioning wall 21 and the second cushioning wall 22 are used to bind the article 100 up to allow the article to be retained in the accepting space 10 and not to be shaken with the air packing bag. Next, air in the accepting space 10 is evacuated to enforce the effect that the first cushioning wall 21 and the second cushioning wall 22 binds the article 100 up. And then, the two sheets of outer film 2*a* and 2*b* are adhered to each other by means of hot sealing to cause the article 100 not to escape from the accepting space 10.

Thereupon, the article 100 can be allowed to retain in the accepting space 10 and not to shake with the air packing bag to enforce the cushioning protection to the article 100. Besides, if the article 100 is provided with a sharp angle or hardware connection corner, the air packing bag can be prevented from being pierced through by the sharp angle or the hardware connection corner of the article 100 by avoiding the shaking of the article 100.

According to the air packing bag mentioned above, the article 100 is first placed in the accepting space 10, and the air cylinder sheet 2 is filled with air. Otherwise, the air cylinder sheet 2 may first be filled with air, the article 100 is not placed in the accepting space 10 until the air filling and the expansion of the air cylinder sheet 2 is completed, the air evacuation is processed after the air filling is completed and the article 100 is then placed in. Besides, the article 100 is first placed in the accepting space 10; the air filling is processed to the air cylinder sheet 2 after the air evacuation is completed.

Figure 6:
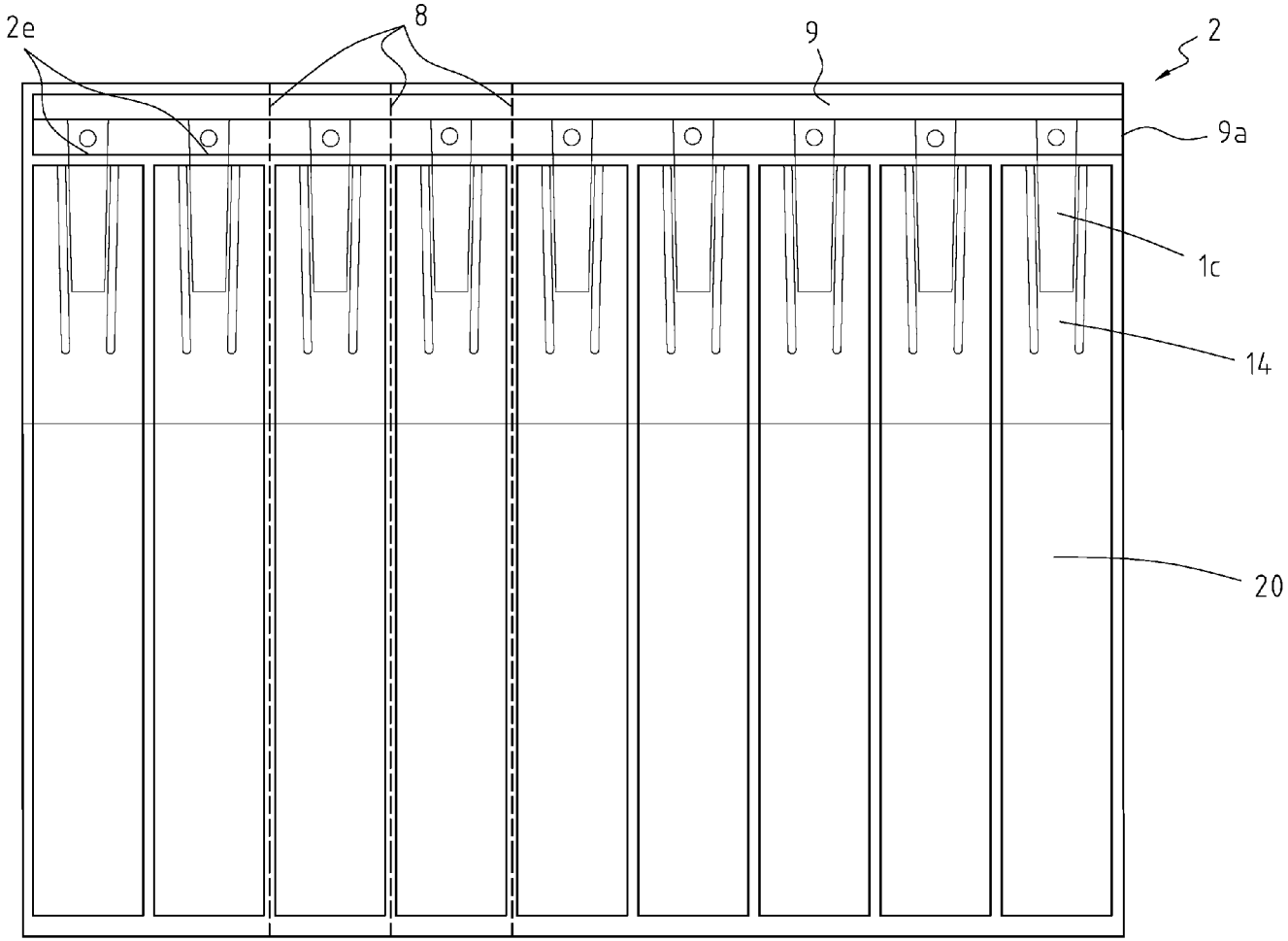
FIG. 6 is a plane view, showing an air packing bag of a second preferred embodiment according to the present invention before air filling.

Please refer to FIG. 6. FIG. 6 is a plane view, showing an air packing bag of a second preferred embodiment according to the present invention before air filling.

In the embodiment, a cutting line 8 may be disposed between the two adjacent air cylinders 20 thereby allowing a user to process cutting along the cutting line 8 to enable each air cylinder 20 to be used independently or cut out the required number of air cylinders 20 depending on the user's requirement.

Figure 7:
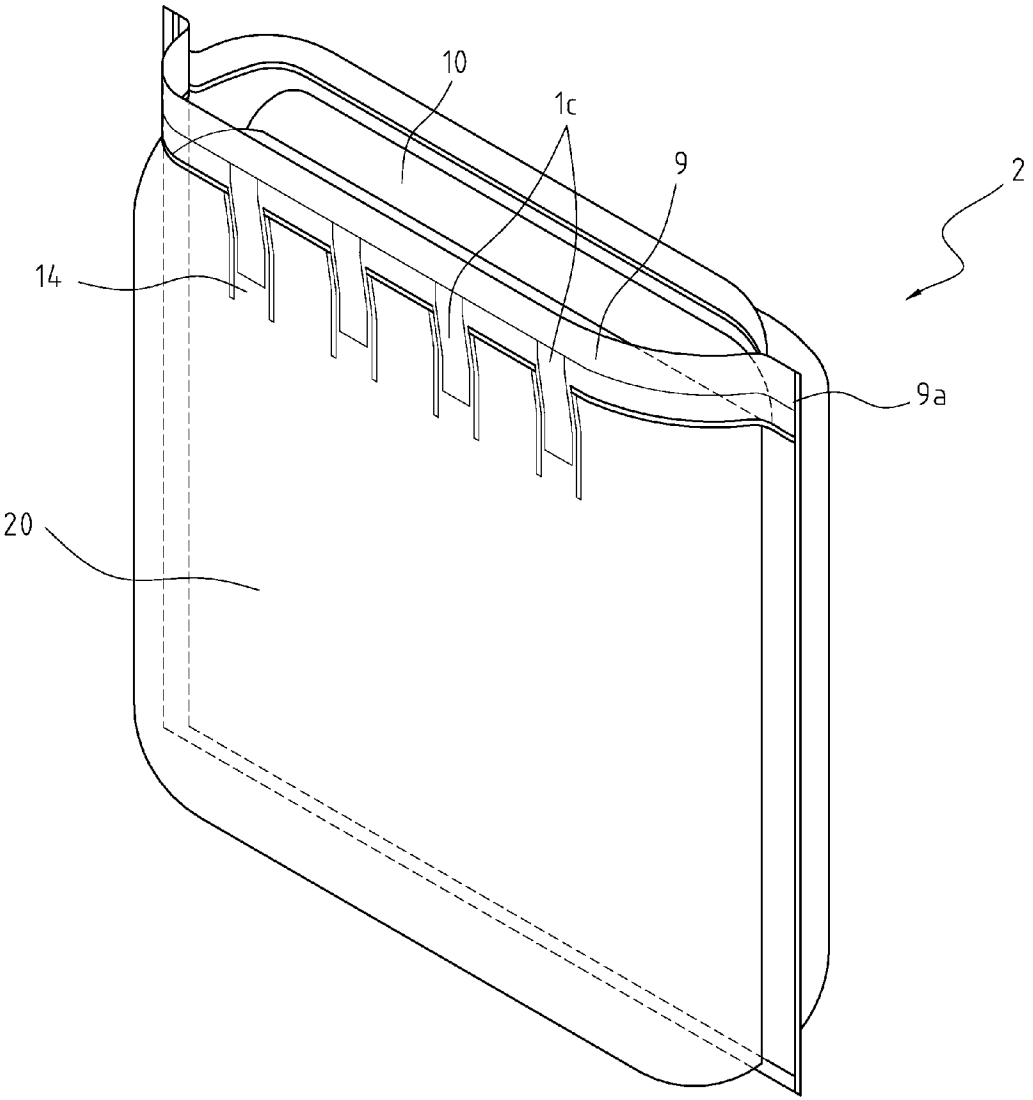
FIG. 7 is a perspective view, showing an air packing bag of a third preferred embodiment according to the present invention after air filling.

Please refer to FIG. 7. FIG. 7 is a perspective view, showing an air packing bag of a third preferred embodiment according to the present invention after air filling.

The air cylinder sheet 2 may also be disposed with only one air cylinder 20 and a plurality of air inlets to allow air to enter the air cylinder 20 via the plurality of air passageways 14 to enable the air cylinder 20 to be filled with air and expanded quickly.

Figure 8:
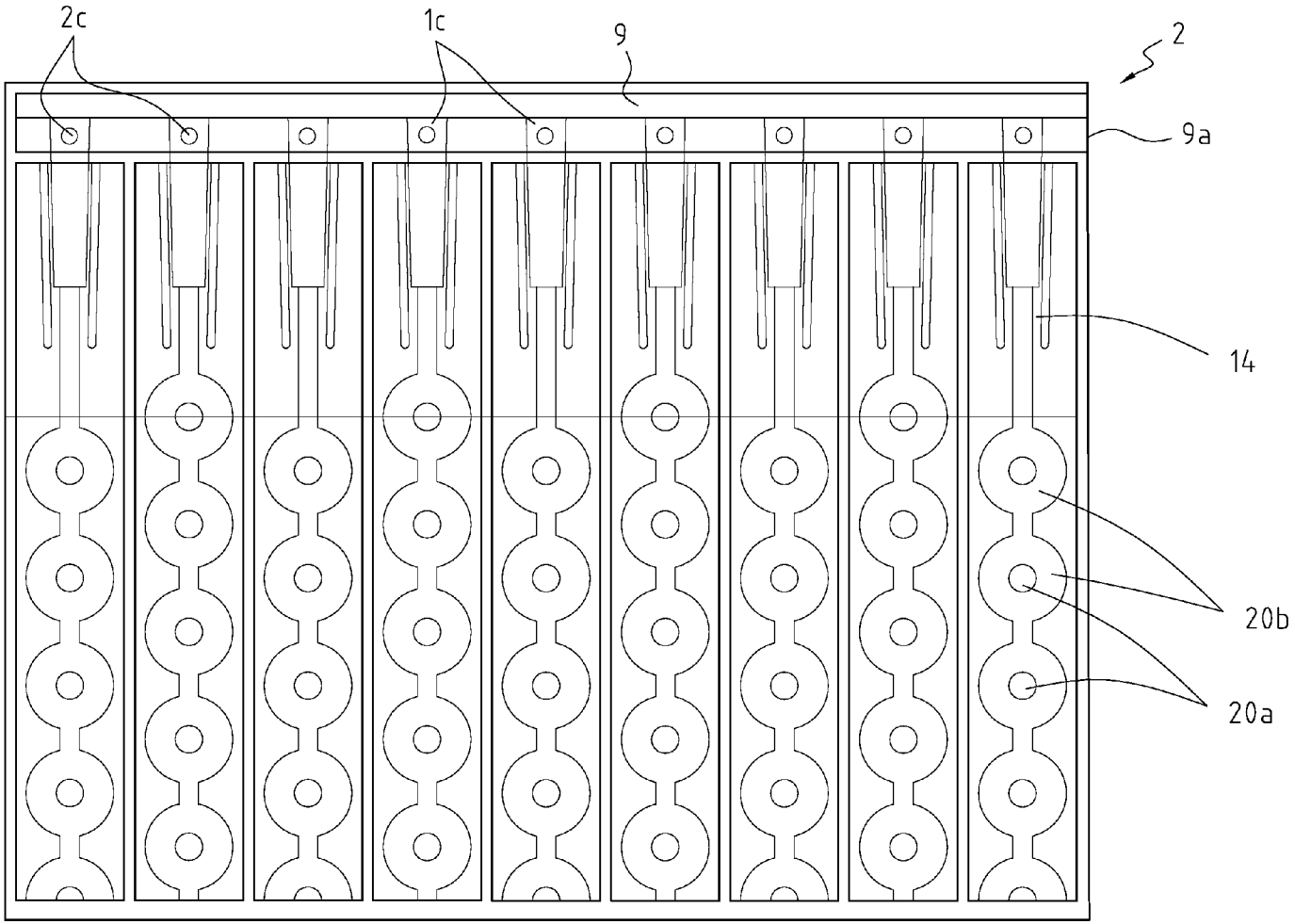
FIG. 8 is a plane view, showing an air packing bag of a fourth preferred embodiment according to the present invention before air filling.
Figure 9:
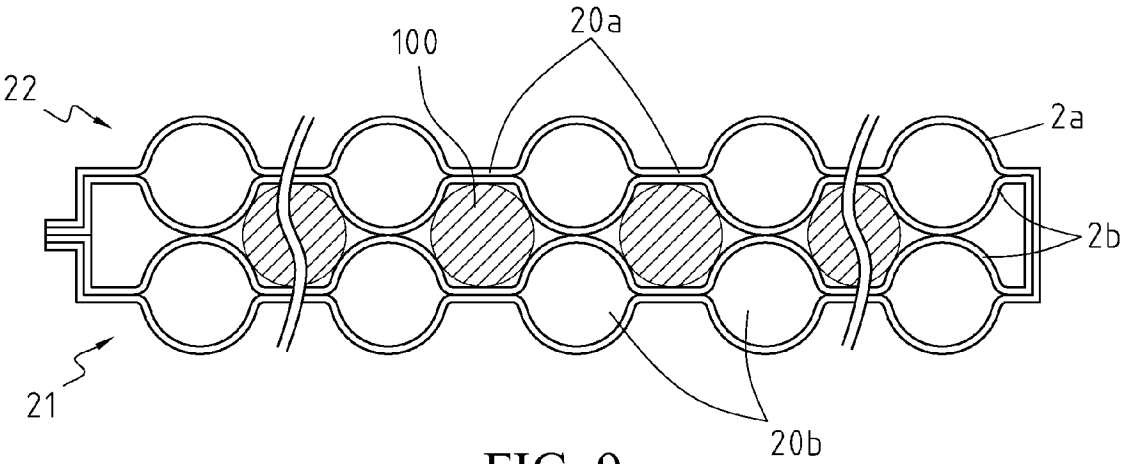
FIG. 9 is a cross sectional view, showing the air packing bag of the fourth preferred embodiment according to the present invention after air filling.
Figure 10:
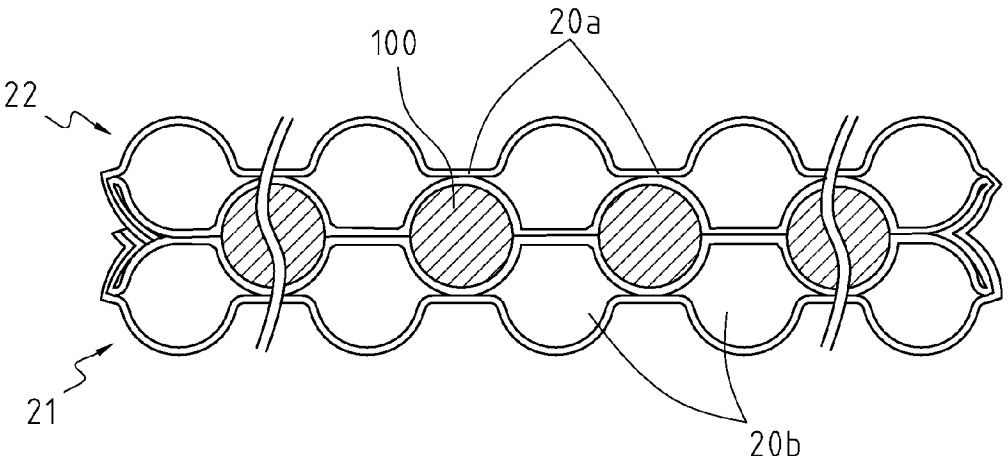
FIG. 10 is a cross sectional view, showing the air packing bag of the fourth preferred embodiment according to the present invention after air filling after air is evacuated.

Please refer to FIGS. 8, 9 and 10. FIG. 8 is a plane view, showing an air packing bag of a fourth preferred embodiment according to the present invention before air filling. FIG. 9 is a cross sectional view, showing the air packing bag of the fourth preferred embodiment according to the present invention after air filling. FIG. 10 is a cross sectional view, showing the air packing bag of the fourth preferred embodiment according to the present invention after air filling after air is evacuated.

The air packing bag further comprises at least one hot pressing node 20*a* and at least one circular loop portion 20*b* positioned on the air cylinder 20, in which the hot pressing node 20*a* is formed by adhering the two sheets of outer film 2*a* and 2*b* by means of hot sealing and each circular loop portion 20*b* surrounds each hot pressing node 20*a*. When the air cylinder 20 is filled with air and expanded, the article 100 is let in the hot pressing nodes 20*a* and wrapped by the circular loop portion 20*b*, and air in the accepting space 10 is evacuated through the air evacuation component 5; this is able to not only prevent the article 100 from being shaken with the air packing bag but also enforce the cushioning protection to the article 100.

According to the structure disclosed by the present invention, each two circular loop portions 20*b* of cylinder 20 are communicated with each other such that each circular loop portion 20*b* disposed on the air cylinder is filled with air and expanded with the air cylinder 20 when the air cylinder 20 is filled with air and expanded. Besides, the circular loop portions 20*b* disposed on each two adjacent air cylinders 20 are interlaced, and the circular loop portions 20*b* disposed on the adjacent air cylinders 20 are not communicated with each other.

A packing method using an air evacuative binding type air packing bag comprises the following steps:

Step 1: providing an air cylinder sheet 2.

An air cylinder sheet 2 is constituted by at least one air cylinder 20 and bended to form a first cushioning wall 21 and a second cushioning wall 22. Besides, the present invention further comprises two sheets of outer films 2*a* and 2*b* stacked together vertically and air cylinders 20 are formed by adhering the two sheets of outer film 2*a* and 2*b* to each other by means of hot sealing. After a heat resistant material is spread between two sheets of inner film 1*a* and 1*b*, at least one air inlet 2*e* is formed between the two sheets of inner film 1*a* and 1*b* by not adhering the two sheets of inner film 1*a* and 1*b* even by means of hot sealing, and each air inlet 2*e* is connected with an air passageway 14. In addition, the air packing bag further comprises an air filling passageway 9 positioned at one side of air cylinders 20, and an air filling entrance 9*a* is formed on one end of the air filling passageway 9.

Step 2: bending the air cylinder 2 to from the first cushioning wall 21 and the second cushioning wall 22.

Thereafter, the air cylinder sheet 2 is bended to form a U-typed body, and the cylinders 20 on two side of the U-typed body are the first cushioning wall 21 and the second cushioning wall 22.

Step 3: hot-sealing two sides of the first cushioning wall 21 and the second cushioning wall 22 to form an accepting space 10.

Two sides of the first cushioning wall 21 and the second cushioning wall 22 of the U-typed air cylinder sheet 2 are adhered to each other by hot sealing to form the accepting space 10 used for accepting an article 100.

Step 4: placing the article 100 into the accepting space 10.

Step 5: drawing air out of the accepting space 10 to allow the first cushioning wall 21 and the second cushioning wall 22 to bind the article 100 up.

In Step 5, a user may draw air out of the accepting space 10 through an air evacuation component 5 to allow the accepting space 10 to form an almost vacuum state or a vacuum state to enable the first cushioning wall 21 and the second cushioning wall 22 to bind the article 100 up thereby allowing the article 100 to be retained in the accepting space 10 and not to be shaken with the air packing bag; this not only enforces the cushioning protection to the article 100 but also prevent the air packing bag to be pierced through by a sharp angle or a hardware connection corner of the article 100 by avoiding the shaking of the article 100.

The method disclosed by the present invention further comprises shielding the accepting space by adhering the two sheets of outer film 2*a* and 2*b* by means of hot sealing after the air evacuation is completed to enable the article 100 not to be escaped from the accepting space 10.

In the description mentioned above, when a user places the article 100 in the accepting space 10, and pulls the two sheets of outer film 2*a* and 2*b* apart outward to open the air inlet 2*e* to allow air in the air filling passageway 9 to enter the air cylinder 20 via the air passageway 14 to cause the air cylinder 20 to be filled with air and expanded. After the air cylinder 20 is filled with air and expanded, the internal air pressure of the air cylinder 20 compresses two sheets of inner film 1*a* and 1*b* to attach tightly onto the outer film 2*a* or 2*b* (according to a structure difference, the two sheets of inner film 1*a* and 1*b* may also not be side-attached onto the outer film 2*a* or 2*b* by hung in the air in the air cylinder 20) to cover the air passageway 14 to shield the air cylinder 20 to cause air in the air cylinder 20 not to be leaked out to attain to the air locking effect.

Furthermore, the method according to the present invention further comprises hot-sealing the two sheets of outer film 2*a* and 2*b* to form hot pressing nodes 20*a* on the air cylinder 20, and forming a circular loop portion 20*b* surrounding each hot pressing node, in which each circular loop portion 20*b* surrounds each hot pressing node 20*a*. When the air cylinder 20 is filled with air and expanded, the article 100 is let in the hot pressing nodes 20*a* and wrapped by the circular loop portions 20*b*. Besides, each two circular loop portions 20*b* of the air cylinder 20 are communicated with each other such that each circular loop portion 20*b* disposed on the air cylinder 20 is filled with air and expanded with the cylinder 20 when the air cylinder 20 is filled with air and expanded.

According to the air packing bag of the present invention, the article 100 is first placed in the accepting space 10, and the air cylinder sheet 2 is filled with air. Otherwise, the air cylinder sheet 2 may first be filled with air, the article 100 is not placed in the accepting space 10 until the air filling and the expansion of the air cylinder sheet 2 is completed, and the air evacuation is processed after the air filling is completed and the article 100 is placed in. Besides, the article 100 is first placed in the accepting space 10; the air filling is processed to the air cylinder sheet 2 after the air evacuation is completed.

The air filling passageway 9 mentioned above is the one formed by adhering the two sheets of outer film 2*a* and 2*b* to each other by hot sealing, but it does not limit that the air filling passageway 9 of the present invention is merely formed by adhering the two sheets of outer film 2*a* and 2*b* by hot sealing, the two sheets of inner film 1*a* and 1*b* may also be adhered to each other by hot sealing to form the air filling passageway 9, it is hereby described.

According to the present invention, the article 100 is allowed to retain in the accepting space 10 and not to shake with the air packing bag; this not only enforces the cushioning protection to the article 100 but also prevents the air packing bag from being pierced through owing to the shaking of the article 100. Besides, the outer film 2*a* or 2*b* need not be extraordinarily enforced or thickened so that the product cost of the air packing bag can be reduced substantially.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An air evacuative binding type air packing bag, comprising:

two outer films, stacked together vertically;

two inner films, positioned between the two outer films, a heat resistant material being spread between the two inner films;

at least one air cylinder, formed between the two outer films by adhering the two outer films to each other by means of hot sealing and used for storing air;

an air filling passageway, positioned at one side of the air cylinder;

at least one hot sealing point, positioned in the air filling passageway and between one sheet of the outer film and one sheet of the inner film, and sticking one sheet of the outer film to one sheet of the inner film;

at least one air inlet, formed by adhering the two inner films to each other by means of hot sealing and used for communicating the air cylinder with the air filling passageway, air entering the air filling passageway pulling apart the two sheets of the outer film outward, and driving two sheets of the unstuck inner film to pull apart outward through the hot sealing points to open the air inlet, allowing the air to be filled in the air cylinder via the air inlet;

a first cushioning wall, formed by bending one side of the air cylinder;

a second cushioning wall, formed by bending another side of the air cylinder; and an accepting space, positioned between the first cushioning wall and the second cushioning wall and used for accepting an article, air in the accepting space being evacuated to allow the first cushioning wall and the second cushioning wall to bind the article up.

2. The air evacuative binding type air packing bag according to claim 1, further comprising an air evacuation component used for drawing air out of the accepting space.

3. The air evacuative binding type air packing bag according to claim 1, further comprising at least one air passageway connected to the air inlet and formed between the two inner films by adhering the two inner films by means of hot sealing.

4. The air evacuative binding type air packing bag according to claim 1, wherein air in the air filling passageway is filled in each air cylinder via each air inlet, air in each air cylinder compresses the inner films to form an air locking.

5. The air evacuative binding type air packing bag according to claim 1, wherein the air filling passage is formed by adhering the two outer films or the two inner films to each other by means of hot sealing.

6. The air evacuative binding type air packing bag according to claim 1, further comprising at least one cutting line positioned at one side of the air cylinder.

* * * * *